United States Patent [19]

Bossut

[11] 4,195,671

[45] Apr. 1, 1980

[54] APPARATUS FOR USE IN A WEAVING PROCESS

[75] Inventor: Achille Bossut, Tupin-et-Semons, France

[73] Assignee: J. Brochier Soieries, Lyons, France

[21] Appl. No.: 928,115

[22] Filed: Jul. 25, 1978

[30] Foreign Application Priority Data

Jul. 26, 1977 [FR] France ..... 77 23840
Oct. 25, 1977 [FR] France ..... 77 33096
Oct. 25, 1977 [FR] France ..... 77 33097

[51] Int. Cl.[2] ..... D03C 3/20
[52] U.S. Cl. ..... 139/455; 139/456
[58] Field of Search ..... 139/55.1, 455, 456, 139/317, 319; 66/154 A; 137/862

[56] References Cited

U.S. PATENT DOCUMENTS 3,103,953 9/1963 Lauritsen ..... 139/455
3,664,383 5/1972 Minchey et al. ..... 139/456

FOREIGN PATENT DOCUMENTS 608317 9/1960 Italy ..... 139/55.1
405980 3/1974 U.S.S.R. ..... 139/456

*Primary Examiner*—Henry Jaudon
*Attorney, Agent, or Firm*—Arnold, White & Durkee

[57] ABSTRACT

Apparatus for the individual control of the raising and lowering movement of warp yarns on a fabric weaving loom, in which the warp yarns are passed through guide eyes, these eyes being mounted on the piston rods of fluid pressure operated piston and cylinder jacks. There are a large number of jacks, these being grouped in a plurality of units which are removable and are juxtaposable with respect to number and position in accordance with the desired density of warp threads, the units being arranged in at least two tiers. This gives great flexibility of control.

10 Claims, 8 Drawing Figures

APPARATUS FOR USE IN A WEAVING PROCESS

BACKGROUND OF THE INVENTION

The present invention relates to an improved apparatus for the individual control of the raising and lowering movement of the warp threads on a weaving loom.

DESCRIPTION OF THE PRIOR ART

In the usual technique of weaving a patterned fabric of the silk type, the interweaving of the warp threads and the weft threads is essentially carried out as follows: each warp thread is engaged in an eye, suspended by a cord loop, fixed to a hook connected to certain members of a patterning mechanism. This mechanism in particular comprises a jack which subjects the eye to a rising and falling movement. During the first stage of this movement, the hooks selected by a programmer, for example a punched card or tape, are raised and the shed (that is to say the divergent angle which the warp threads now form between one another) is opened. At this instant the first weft thread is inserted into this shed, and is then beaten up on the edge of the fabric by means of a reed. This happens whilst the shed closes gradually during the second stage of the movement of the jack, which resumes its initial position. At that stage, a fresh selection of the hooks is made by means of a further part of the tape or a second punched card, which has come to take the place of the preceding card, and a cycle similar to the preceding cycle now takes place, and so on.

In silk weaving, the patterning mechanism is currently equipped with a number of hooks very much smaller than the number of threads composing the warp of a patterned fabric of the silk type. Consequently, in the case of high densities of warp threads, each hook necessarily controls the lifting of several warp threads, and consequently subjects these to identical movements, which obviously constitutes a limitation.

Furthermore, the production of a patterned fabric of the silk type requires the bringing into position of a mounting, that is to say a precise selection and rigorous setting up of the eyes, the cord loops, the spindles and the like, and all these operations can only be carried out by very experienced specialists, who are increasingly rare. Now a mounting is in particular specific for a density of warp threads, a width of fabric, and a given number of repeats of the design of the patterned fabric (that is to say the number of designs reproduced over one width). It will thus be understood that these mountings, which have to be adapted to each particular case which arises, take a long time to set up and are very expensive. Furthermore, this method of working is opposed to the needs of novelty, the essential role of which is creation and fashion, which make it necessary to manufacture a wide variety of articles which furthermore should be assured of the broadest possible market.

Numerous solutions have already been proposed for individually controlling the movement of the warp threads on a weaving loom.

Thus, U.S. Pat. No. 3,224,465 describes the formation of an undulating web or shed by individual control of each warp thread by means of a piston which moves in a fixed cylinder and is connected to a programming device which permits the movement of the piston. Such a device is suitable for the production of plain fabrics but does not make it possible to obtain patterned fabrics or to achieve a high density of warp threads or to vary this density easily.

German Pat. No. 93,460 and U.S. Pat. Nos. 3,853,150; 2,558,284 and 3,817,297 also describe the control of similar movements of the warp threads, but the devices proposed for this purpose again do not make it possible easily to achieve high densities of warp threads or to change such densities conveniently.

The object of the present invention is to provide an improved apparatus for the individual control of the warp threads which make it possible to achieve these latter objectives, which it has not hitherto been possible to achieve, and also to overcome the disadvantages of the earlier apparatuses.

SUMMARY OF THE INVENTION

In general terms, the invention relates to an apparatus for the individual control of the raising and lowering of the warp yarns of a fabric weaving loom, said apparatus comprising, in combination:

(a) a plurality of piston-and-cylinder jacks, the cylinders being grouped in a plurality of units which are removable and juxtaposable with respect to position and number;

(b) a piston rod connected to the piston of each jack;

(c) a warp yarn guiding eye mounted on each piston rod; and (d) a programmer for controlling under the movement of the pistons, and thus of the warp yarns to provide a desired pattern in the fabric.

By virtue of the apparatus according to the invention, the eyes of the weaving looms are freed from the conditions and restrictions which have applied to them hitherto, and it is possible to adapt the working conditions more easily and more rapidly to the various factors to be taken into consideration (type of fabric, width of fabric, density of the warp threads, number of repeats of the design and the like). Thus, the frequency and length of the mountings are reduced to the maximum extent, which is beneficial from every point of view.

Advantageously, a plurality of units of jacks are arranged in at least two tiers, one above the other, with the piston rods extending generally vertically.

Preferably, on each tier, in a given element or module, the cylinders of the jacks are identical, contiguous, arranged staggered on adjacent rows, and advantageously provided with lateral flattened portions at their tangential contact generatrices.

Preferably, furthermore, each axis of the cylinder of a jack in a given tier is of curvilinear polygonal cross-section channel, formed between cylinders of a unit of another tier.

Such an arrangement makes it possible to achieve very high densities of warp threads which can reach one hundred and fifty threads/cm, these threads being controlled individually and thus making it possible to produce patterned designs, without a repeat, over the width of the fabric, which it has hitherto not been possible to do industrially. Furthermore, depending on the number and positioning of the juxtaposable units, it is possible easily to vary the density of warp threads.

According to another feature of the invention, each juxtaposable unit comprises, on each tier, two rows of cylinders arranged staggered, held on a rigid support of substantially parallelepiped shape, this support being positioned and held, for each tier, by means of two cross-bars located facing one another, on which cross-bars the juxtaposable units can move.

Furthermore, at least one of these crossbars can be moved transversely relative to the other, so as to vary the orientation of the removable units relative to the direction of the warp threads in accordance with the desired density of these threads in the article to be produced.

According to the invention, to actuate the jacks whose pistons individually and independently control the warp threads, it is possible to resort to any appropriate means, for example mechanical, hydraulic, fluidic, electromagnetic or piezoelectric means, and also pneumatic or electro-pneumatic means (or several of these means at a time), the jacks in every case being themselves actuated by appropriate programming agents (punched cards, computers or other means).

The movement of the pistons of the jacks can be controlled by connecting the head of each cylinder to two sources of fluid at different pressures, by interposition of a throttling distributor, the connection of which to one or other source is controlled by the programming factor, for example consisting of a simple tape of the punched paper type, which tape thus serves to bring the throttling member into communication with one or other of the abovementioned sources of fluid.

The movement of the throttling member in question can also be brought about by electromagnets which are themselves controlled by the programming factors mentioned above.

Various preferred embodiments of the invention will now be described, purely by way of example, with reference to the accompanying drawings.

DETAILED DESCRIPTION OF PREFERRED EMBODIMENTS

Figure 1:
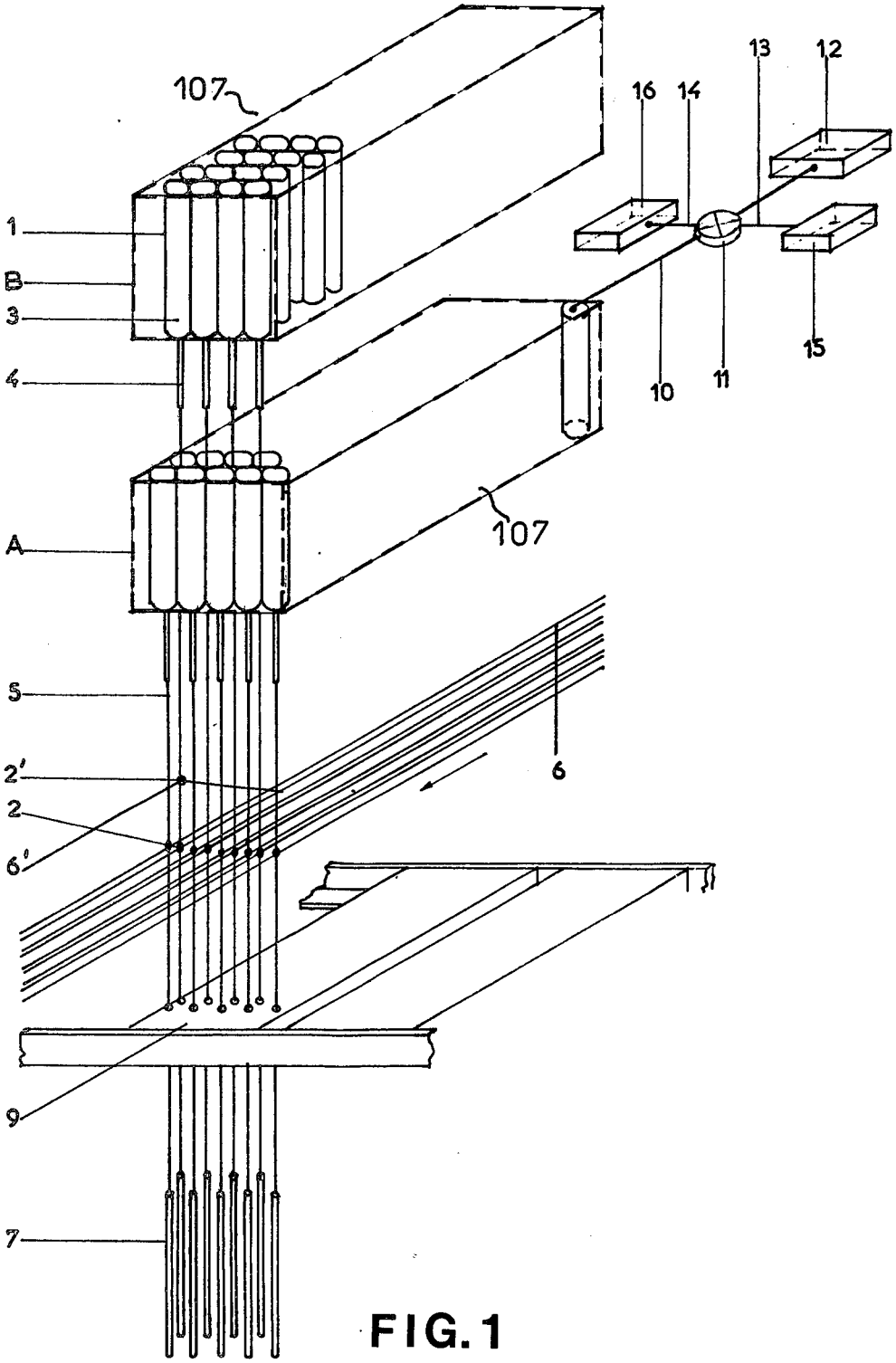
FIG. 1 shows schematically, in perspective, a part of one embodiment of apparatus according to the invention, suitable for the manufacture of a patterned fabric of the silk type.

Referring to FIG. 1, the warp threads 6 are shown guided by eyes 2 mounted on the pistons 4 of fluid pressure operated jacks 1 which are arranged in two tiers, a lower tier A and an upper tier B. These jacks 1 essentially consist of cylinders 3, preferably provided with uniformly distributed lateral flat portions at their tangent generatrices, and in each of which a piston 4 moves under the action of a pneumatic force.

The cylinders 3 and their pistons 4 are arranged in groups 107, which are removable and juxtaposable in respect of number and position in accordance with the desired density of warp threads. In this FIG. 1, for simplicity, only one group 107 has been shown for each tier and holding and positioning elements have not been illustrated. Furthermore, again in this Figure, the conventional weaving members, namely the reed, the slay and the like, being wellknown, have also not been shown.

Each of the pistons 4 is connected vertically, via a vertical wire-like piston rod 5, which is preferably rigid, to an eye 2, through which passes transversely one of the warp threads 6, which move horizontally. Each wire-like piston rod 5 extends, still vertically, beyond its eye 2 and is fixed, at its bottom end, to a doup 7 which serves as a counterweight.

The jacks 1 are arranged vertically and contiguously with one another, in parallel rows arranged staggered (compare FIG.2), with the axis of each jack 1B (shown in solid lines) of the upper tier B coinciding with the axis of a vertically extending constant curvilinear triangular cross-section channel T (shown in accentuated lines) formed between adjacent jacks 1A (shown in broken lines) located at the lower tier A. This position is achieved by suitably staggering, longitudinally and transversely, the vertical planes of the adjoining rows $r_A^1$, $r_A^2$ and so on, and $r_B^1$, $r_B^2$ and so on, of the jacks of the two tiers A and B mounted above the web of the warp threads. Where appropriate, the sides of the curvilinear triangular channels T are in part in the plane of the flat portions of the cross-sections of these cylinders, which have been arranged for this purpose.

Figure 2:
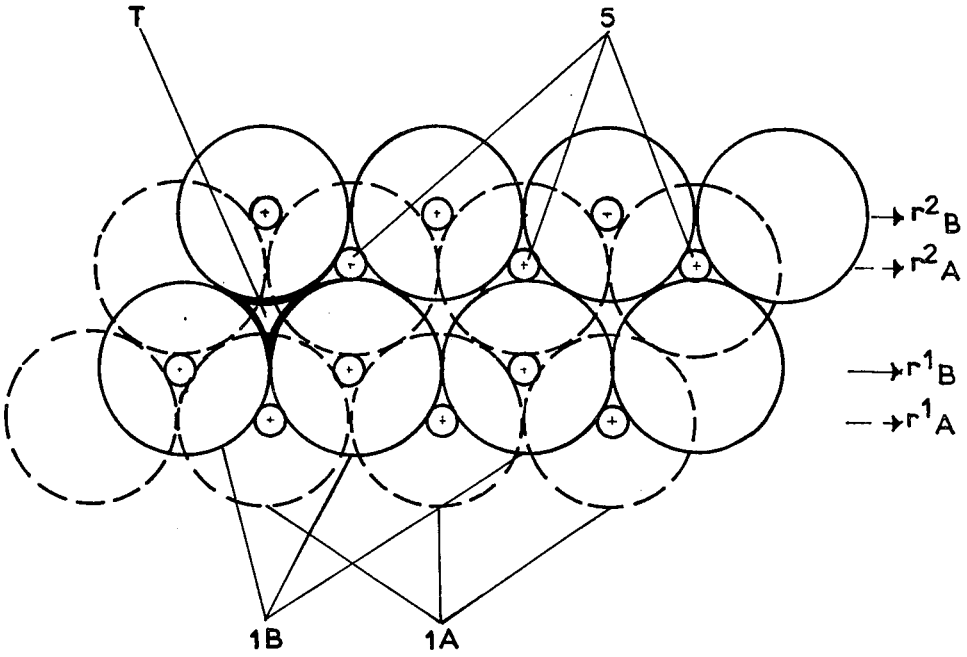
FIG. 2 shows schematically, in plan view, the arrangement of the members, cylinders and pistons of the said apparatus, the members being those which are involved in the control of the warp threads of the fabric.

This staggered arrangement, which is shown clearly in FIG. 2, has the advantage of spatially concentrating, to the maximum extent, the jacks 1 relative to one another (and hence of reducing the bulk to the maximum extend), whilst providing passages for the wire-like piston rods 5 for the control of the eyes 2. If there are three tiers in place of two, the overall arrangement is the same, but with the staggering of the rows adjusted to meet this case, and the channels will then have a cross-section in the shape of a curvilinear hexagon.

In one advantageous construction, cylindrical jacks are used which have an external diameter, of the cylinders, of six millimeters (with a wall thickness of five-tenths of a millimeter) and advantageously piston rods 5 having an external diameter of seven-tenths of a millimeter (and a thickness of one-tenth of a millimeter) are located in the channels of curvilinear cross-section. The cylinders have a height of ten centimeters, allowing their pistons a stroke of eight centimeters, which provides the opening required for a normal shed of warp threads.

Finally, as shown in FIG. 1, a transverse guide 9 can be located between the eyes 2 and the spindles 7, the guide being provided with holes through which the abovementioned piston rods 5 pass, and the purpose of which is to ensure that these piston rods are perfectly vertical under all circumstances.

The upper part of each cylinder 3 of the jacks 1 is connected by a pipeline 10 to a throttling distributor 11, such as a three-way valve, remote-controlled electrically (or electromagnetically or electronically) by any appropriate means such as a programming computer 12. The distributor is connected via pipelines 13 and 14 to, respectively, a negative pressure source (vacuum source) 15 and a positive pressure source 16 (for example under an absolute pressure of 1.3 kilograms/sp.cm). Thus, if a particular warp thread 6 has to be moved away, the programmed computer 12 breaks the connection, in the valve 11, to the source of compressed air 16 (if this has not already been broken) and makes the connection to the vacuum source 15 (if this has not already been made).

The head of the cylinder of the jack 1 in question is thus under reduced pressure, which causes an upward movement of the piston 4 of this cylinder and hence an equivalent movement of the piston rods 5 connected to this piston 4, and consequently of the eye 2'. The ultimate effect is that the eye 2 is raised to the position 6' the warp thread 6 which passes through this eye 2, which has moved to 2'.

Thus it causes the opening of the shed of warp threads, which allows the member which carries the weft thread, such as a shuttle, fluid under pressure or the like (not shown in the drawing) to insert this weft thread between the warp threads which have just been raised and those which have not been raised.

After this, the reed applies the weft thread which has just been introduced, against those weft threads which have already been introduced. Thereupon the valve 11, still controlled by the computer 12, breaks the connection to the source of vacuum 15 and makes the connection to the source of pressure 16, which causes the piston 4 to be returned to its initial position, assisted therein by the doup 7, so that finally the eye 2 also returns to its starting point, replacing the thread 6' in the web of warp threads.

The cycle continues in this way up to the end, in accordance with the program provided to the computer. Ultimately, the woven fabric, wound up on its beam (not shown in the drawing) is taken off.

If it is desired to set up a different fabric there is no need to carry out dismantling and mounting operations which are long, delicate, expensive and require highly specialised labour. It suffices to feed a fresh program to the computer, in accordance with the new paramaters to be taken into consideration (width of the fabric, repeats of the designs, and density of the warp threads) and from there onwards, after the usual simple arrangements (feeding, winding up and possibly pirn winding) it is possible to proceed directly to the production of the new fabric.

Figure 3:
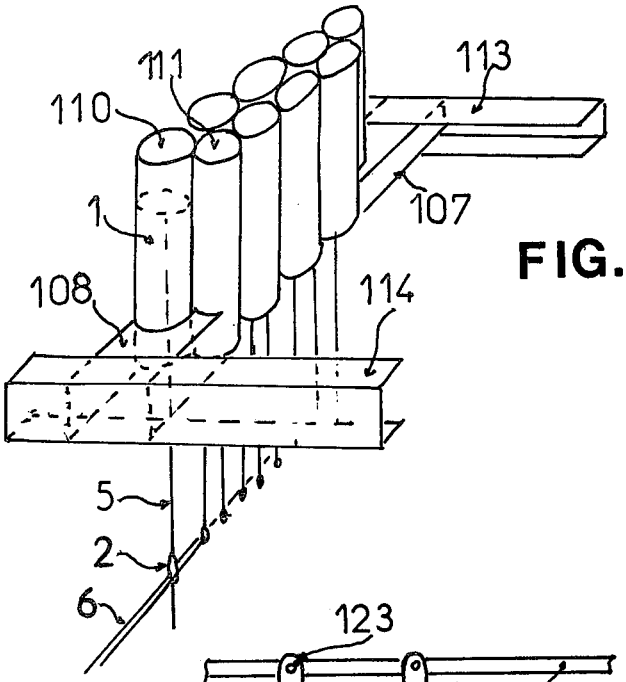
FIG. 3 is a partial schematic view, in perspective, showing a tier of an embodiment in which the control cylinders are grouped in the form of a juxtaposable unit comprising two rows of cylinders arranged staggered.
Figure 4:
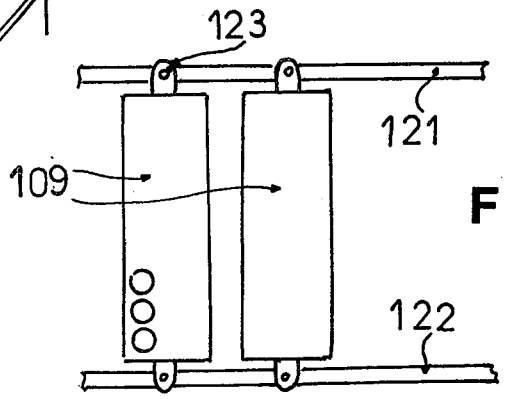
FIGS. 4 and 5 illustrate partially, in plan view, another embodiment by means of which the density of the warp threads in the fabic produced can easily be varied and the warp threads can be positioned substantially parallel to one another.
Figure 5:
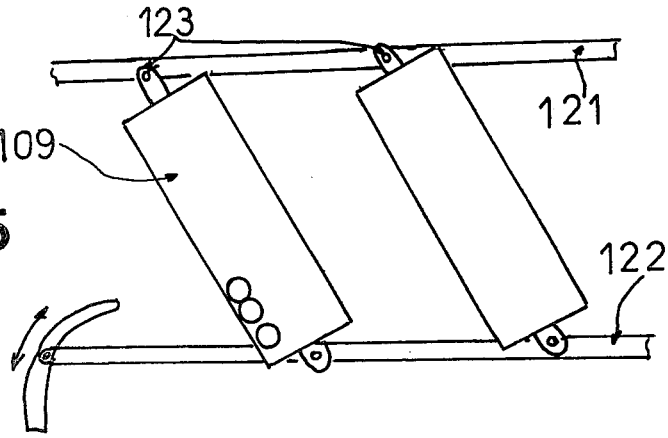

FIGS. 3, 4 and 5 show in greater detail the way in which the jacks are grouped in juxtaposed units, which make it possible easily to vary the density of warp threads.

In the embodiment illustrated in FIG. 3, the jacks 1 are grouped in the form of removable units 107 comprising two rows 110-111 of jacks arranged staggered.

The positioning and holding of these removable units is achieved in a simple manner as shown in the FIG. 3 by a rigid support 108 and by means of two channel-section cross bars 113 and 114, arranged face to face, in which bars the supports 108 can slide and can then be held fixed, for example by means of locking screws (which are not shown).

If it is desired to obtain a fabric of lower density than that manufactured beforehand, it suffices to remove a certain number of the group removable units 107 at each of the ends of the crossbars 113 and 114 and then to position the remaining removable units 109 of the group 107 relative to one another over the entire width of the loom, if necessary using separating spacers between adjacent units.

On the other hand, it is also possible to produce articles of lower width and having the same density as the articles produced previously. In that case, only the number of removable units 109 of the group 107 corresponding to the width of the fabric to be produced is retained.

Advantageously, in a particular embodiment of the invention, the removable units are held in the manner shown schematically in FIGS. 4 and 5. In this case, these units are held by means of two cross bars 121 and 122 in the form of rails, at least one of these cross bars, for example cross bar 122, being movable transversely relative to the other, in accordance with the density of weft threads to be obtained. The removable units 109 of the group 107 are fixed on the cross bars 121 and 122 by means of locking 123, such as screws. These removable units 109 can on the one hand slide in the cross bars 121 and 122 and on the other hand be oriented differently relative to the direction of the warp threads, in accordance with the desired spacing of the cross bars.

By means of such a mounting it is possible easily to vary the density of warp threads and if the latter is low, to regulate the divergence between the threads and hence to avoid the threads rubbing against one another, this being an advantage which applies regardless of the nature of the fabric.

Thus, as is shown in FIG. 4, if it is desired to produce a fabric having a very high density of warp threads, the removable units 109 are virtually brought up against one another over the width of the fabric to be produced and are arranged parallel to the direction of the warp threads.

Conversely, as is shown in FIG. 5, if it is desired to produce an article having a lower density, an appropriate number of removable units 109 is removed at each of the ends of the cross bars and the remaining units are then moved apart so as to space them out well; by a transverse movement of the movable cross bar 122, the units 109 are inclined relative to the direction of the warp threads. In this way, the removable units 109 of the group 107 extend over the entire width of the fabric to be produced and, as has already been stated, the divergence of the threads is reduced and friction between threads is avoided.

Figure 6:
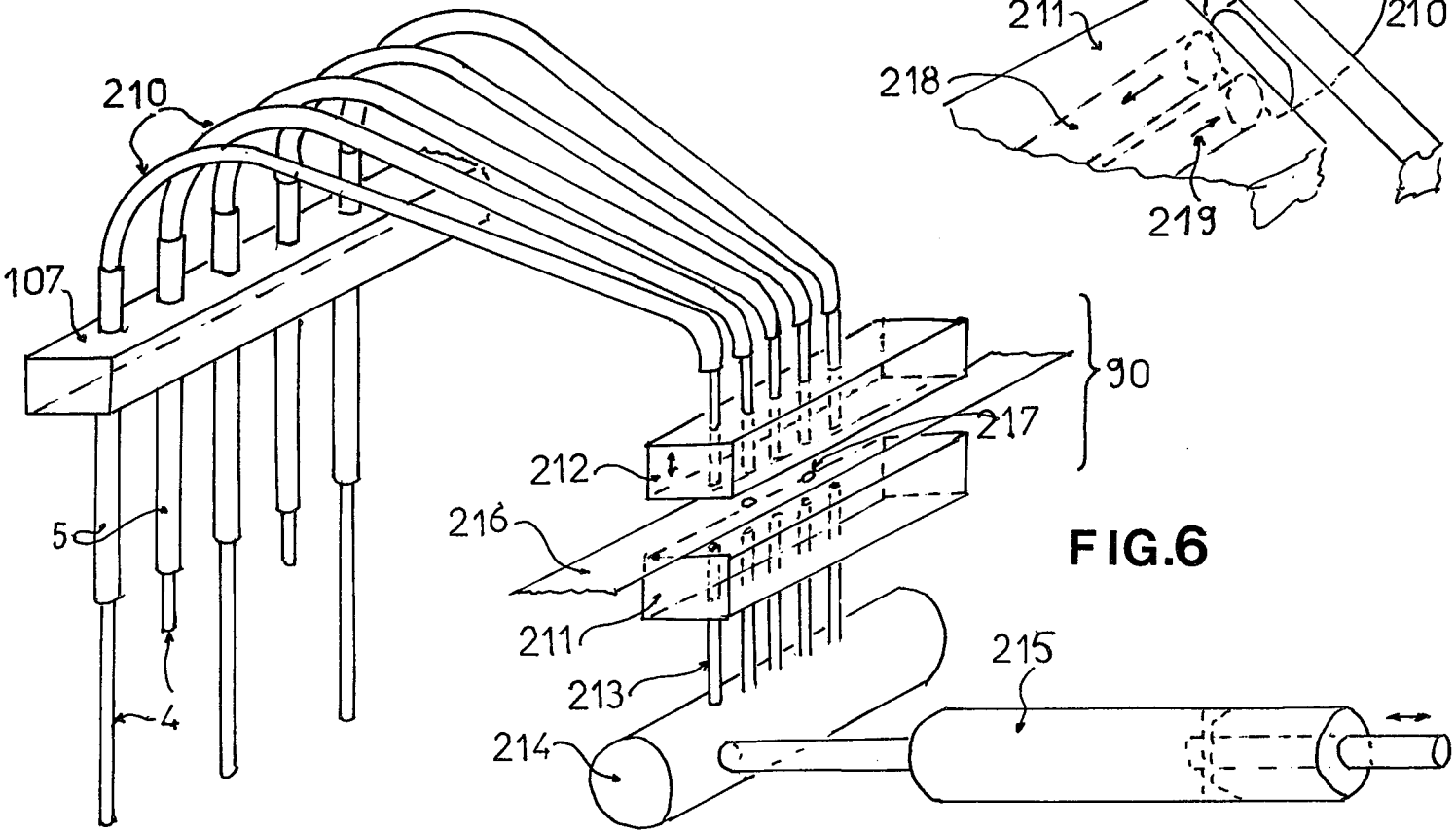

In the embodiment illustrated in FIG. 6, in which the programmer includes a punched paper tape, the apparatus according to the invention comprises a set of individual control pistons 4 for the weft threads, the pistons being able to slide inside cylinders 3. Each cylinder is connected individually, by means of a deformable tube 210, to a distributor unit 90, which allows all the tubes 210 to be connected either to a vacuum source or to a pressure source in accordance with a cycle determined by the programmer.

In the present case, this distributor unit 90 consists of two plates 211 and 212 arranged facing one another, the ends of the deformable tubes 210 being held in the plate 212. The plate 212 can be subjected to a reciprocating movement synchronised with the cycle of the loom and intended either to bring the plate 212 into contact with the plate 211, which is fixed, or to move it away from the latter plate.

The plate 211 carries tubes 213 which open into a manifold 214 which is alternatively subjected to pressure and to suction produced by the movement of a pump 215, synchronised with the cycle of the loom.

Programming is achieved by means of a tape 216, for example of paper, flexible sheet or film, having perforations 217 which are made in accordance with the movement to be communicated to the warp threads. The two plates 211 and 212 are moved apart from one another when the tape 216 moves synchronously with each beating-up to be effected on the loom. By virtue of this device it is thus possible to vary the pressure inside the heads of the cylinders 3 and hence to cause the movement of the pistons 4. When a tube 213 and the corresponding end of the flexible tube 210 fixed in the plate 211 are arranged opposite one another, that is to say when a perforation produced in the paper allows the tubes 210 and 213 to communicate, suction is produced inside the head of the cylinder 3 and consequently the piston 4 is raised and carries with it the warp thread associated with it. Of course, these movements are synchronised with the cycle of the loom and when the appropriate warp threads are raised, the weft is introduced into the shed thus formed.

Figure 7:
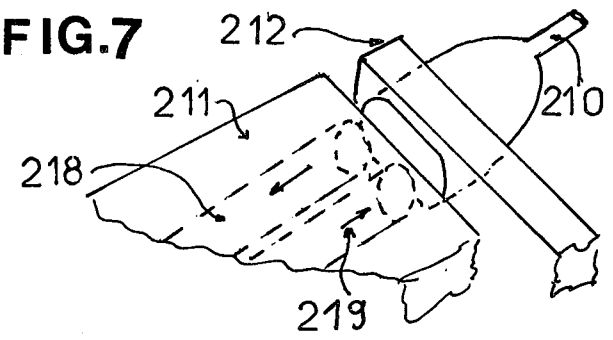
FIGS. 6 and 7 illustrate, in schematic perspective, another embodiment of apparatus according to the invention, in which the programming means essentially consist of a punched tape of the paper type.

In the variant illustrated by FIG. 7, the deformable tube 210 connected to the head of the cylinder is also mounted, for example by clamping, in the movable plate 212. The end of this deformable tube 210 has an essentially ellipsoidal shape and can come opposite means which allow negative or positive pressure to be set up inside the head of the cylinder 3. In the case in question, the negative of positive pressure is achieved by means of two tubes 218 and 219, mounted side by side in the plate 211, 219 being connected individually to a pressure source and 218 individually to a suction source.

As indicated above, the programmer includes, in this case, a paper tape punched in such a way that in accordance with the desired selection, one or other of the orifices of the tubes 218 and 219 is blocked. For example, when the orifice connected to the suction source is blocked by the paper, the other orifice, connected to the excess pressure, will allow the fluid to pass, which causes lowering of the piston, and vice versa in the converse case. As before, these movements are of course synchronised with the cycle of the loom.

Bringing the cylinder heads of the jacks into communication with one or other of the sources of fluid at different pressures can be controlled by any suitable blocking distributing device. It is possible to use for this purpose, with advantage, electromagnetic valves of a type which is in itself known, essentially comprising a case with two ports which each communicate with one of the two abovementioned sources, a slide with a port which is itself connected to a cylinder head, the said slide being able to move so as to allow its port to come opposite one or other port of the valve case, and, finally, electromagnets arranged laterally relative to the slide and capable, depending on the direction of the current exciting these magnets, of attracting the slide electromagnetically and causing the slide to move in one or other direction, the final effect being to bring one or other source into communication with a jack cylinder head, thereby causing, when appropriate, the lifting of the piston and hence of the warp thread connected thereto, as has been explained above.

Figure 8:
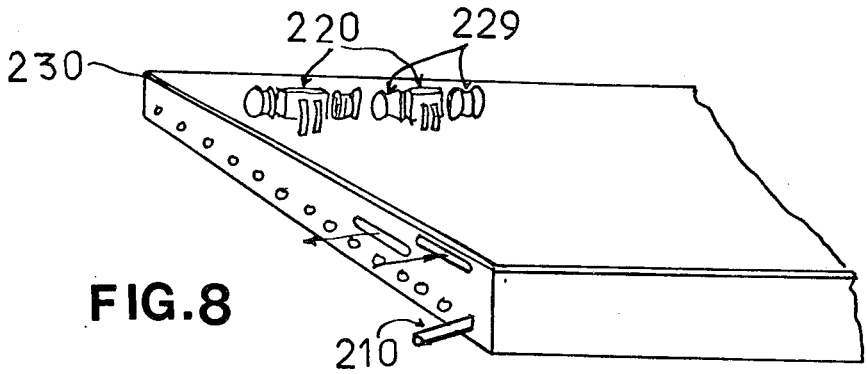
FIG. 8 is a schematic perspective view illustrating one way in which a plurality of members for controlling the warp threads of an apparatus according to the invention can be mounted.

This embodiment is particularly advantageous and makes it possible to obtain a compact distribution unit, as is shown in FIG. 8. Valves 220 and their electromagnets 229 are arranged on panels which comprise several internal operating levels and have a thickness of about two centimeters.

In general terms, any one of these levels comprises the printed circuit 230 connecting the controls to the electromagnets, with the terminal bars being on one side of the panel, this level being about three millimeters thick.

Another level comprises passages for the fluidic circuit which connects each valve to the corresponding piston 210, the thickness of this level being about six millimeters.

Finally, the suction and pressure manifolds are arranged on a last level, the thickness of which is also about six millimeters.

It is obvious that the arrangement of the various levels given in the embodiment illustrated in FIG. 8 does not imply a limitation. Thus, for example, the orifices to which the tubes 210 are connected can be arranged on several levels and the fluidic circuits on a single level, though it is to be understood that preferably the unit comprises several levels each corresponding to a particular function.

If the valves are arranged on panels as described, these are advantageously supported over their width by means of two bars in the shape of a U which can be moved apart so as to allow the panels to be removed or to be locked in order to place them in position; these support bars also serve for the various electrical and pneumatic connections.

The apparatus according to the invention is simple, efficient and easily adaptable to any type of weaving loom, so as to allow individual control of the warp threads for the purpose of producing jacquard articles. Furthermore, these devices make it possible easily to produce various fabrics comprising warp thread densities which can vary within wide limits.

I claim:

1. An apparatus for the individual control of the raising and lowering of warp yarns of a fabric weaving loom, said apparatus comprising:

a plurality of jacks, each of said jacks having at least one cylinder and one piston, said jacks arranged in groups as units with respect to one another;

piston rods connected to said pistons on each said jacks;

a warp yarn guiding eye mounted on each of said piston rods;

a programmer for controlling the movement of said pistons, thus controlling the warp yarns for providing a desired pattern in the fabric; and said plurality of saidjacks being removable and juxtaposable with respect to position and number in accordance with a desired density of said warp yarns, and further arranged in at least two tiers, said tiers being in spaced elevational relationship to one another, above said warp yarns, such that said piston rods extend in a generally vertical direction.

2. Apparatus as claimed in claim 1, wherein on each tier the cylinders of the jacks are identical for each unit and are contiguous and arranged staggered in adjacent rows.

3. Apparatus as claimed in claim 2, wherein each axis of a cylinder of a jack in a given tier is of curvilinear polygonal cross-section channel, formed between cylinders of a unit of another tier.

4. Apparatus as claimed in claim 1, and further comprising a rigid support on which the cylinders of a unit are mounted and two spaced apart cross bars on which the rigid support is removably mounted.

5. Apparatus as claimed in claim 4, wherein at least one of the crossbars can be moved transversely relative to the other, so as to be able to alter the orientation of the units relative to the direction of movement of the warp threads.

6. Apparatus as claimed in claim 1, wherein the movement of the piston is controlled by electrical means.

7. Apparatus as claimed in claim 1, and further comprising pneumatic means for controlling the movement of the pistons of the jacks, said pneumatic means being controlled by said programmer.

8. Apparatus as claimed in claim 7, wherein the pneumatic means includes two sources of fluid at different pressures, a throttling distributor and fluid connections from said cylinders to said distributor, the opening and closing of which, in respect of one source or the other, is controlled by the programmer.

9. Apparatus as claimed in claim 8, in which the fluid connection between the pneumatic means and each cylinder is a tube, of which one end, fixed to the cylinder opens into the interior of the latter, in which the programmer includes a punched tape, a first member mounted adjacent the path of movement of the tape connected to said sources of pressure and a further member mounted on the other side of said punched tape from said first member and connected to said tube, whereby the various tubes can be brought into communication with one or other source by the position of said punched tape.

10. Apparatus as claimed in claim 8, wherein the throttling distributors are constructed as valves and further comprising a panel of low thickness comprising several internal levels of which one comprises at least one printed circuit for controlling the valves, another comprises connections between the fluidic circuits and the cylinders and yet another comprises the communications with each of the two sources of fluid, the valves being mounted on said panel.

* * * * *